US005635666A

United States Patent [19]

Bannasch et al.

[11] Patent Number: 5,635,666

[45] Date of Patent: Jun. 3, 1997

[54] FLARE MASS FOR A DUMMY TARGET FOR PRODUCING A SELECTED SPECTRUM

[75] Inventors: Heinz Bannasch, Schönau; Martin Wegscheider, Bayerische Gmain; Martin Fegg; Horst Bösel, both of Berchtesgaden, all of Germany

[73] Assignee: Buck Werke GmbH & Co., Bad Uberkingen, Germany

[21] Appl. No.: 428,117

[22] PCT Filed: Jul. 4, 1994

[86] PCT No.: PCT/DE94/00783

§ 371 Date: Jun. 12, 1995

§ 102(e) Date: Jun. 12, 1995

[87] PCT Pub. No.: WO95/05572

PCT Pub. Date: Feb. 23, 1995

[30] Foreign Application Priority Data

Aug. 19, 1993 [DE] Germany ..... 43 27 976.7

[51] Int. Cl.[6] ..... F42B 12/48; C06B 45/00

[52] U.S. Cl. ..... 102/334; 102/292; 102/336; 149/116

[58] Field of Search ..... 102/334, 292, 102/336; 149/116, 29

[56] References Cited

U.S. PATENT DOCUMENTS

| | | | |
|---|---|---|---|
| 4,624,186 | 11/1986 | Widera et al. | 102/336 |
| 4,659,089 | 4/1987 | Rosa | 342/9 X |
| 4,719,856 | 1/1988 | Joslin | 102/335 |
| 4,719,857 | 1/1988 | Spring | 102/335 |
| 4,728,375 | 3/1988 | Simpson | 102/505 X |
| 4,838,167 | 6/1989 | Prahauser et al. | 102/334 |
| 5,317,163 | 5/1994 | Obkircher | 102/334 |
| 5,499,582 | 3/1996 | Schiessl et al. | 102/336 |
| 5,531,930 | 7/1996 | Karton et al. | 342/3 X |

FOREIGN PATENT DOCUMENTS

| | | |
|---|---|---|
| 3617888 | 12/1987 | Germany . |
| 3037053 | 8/1989 | Germany . |

*Primary Examiner*—Peter A. Nelson

*Attorney, Agent, or Firm*—Hill, Steadman & Simpson

[57] ABSTRACT

A flare mass for dummy target production has an incendiary composition component and an inert component, the weight ratio of the incendiary mass component and the inert component being adjusted such that the maximum of the spectral radiant flux of the flare mass in adaptation to the spectral radiant flux distribution of the target signature to be simulated is displaced toward longer wavelengths compared with the spectral radiant flux distribution of the incendiary mass component alone.

18 Claims, 7 Drawing Sheets

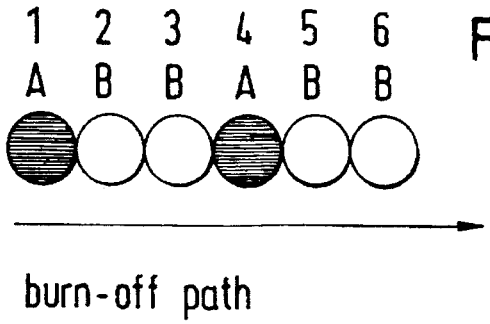
Fig. 3a
Fig. 3b
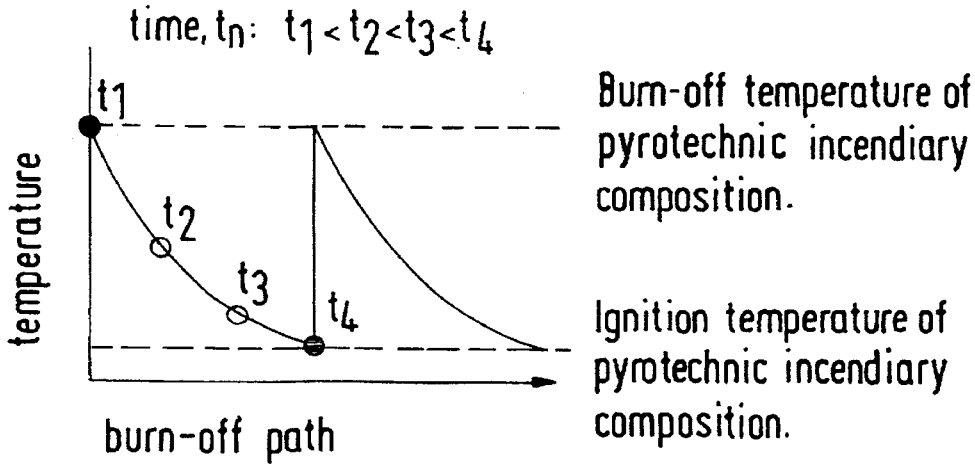
Fig. 3c
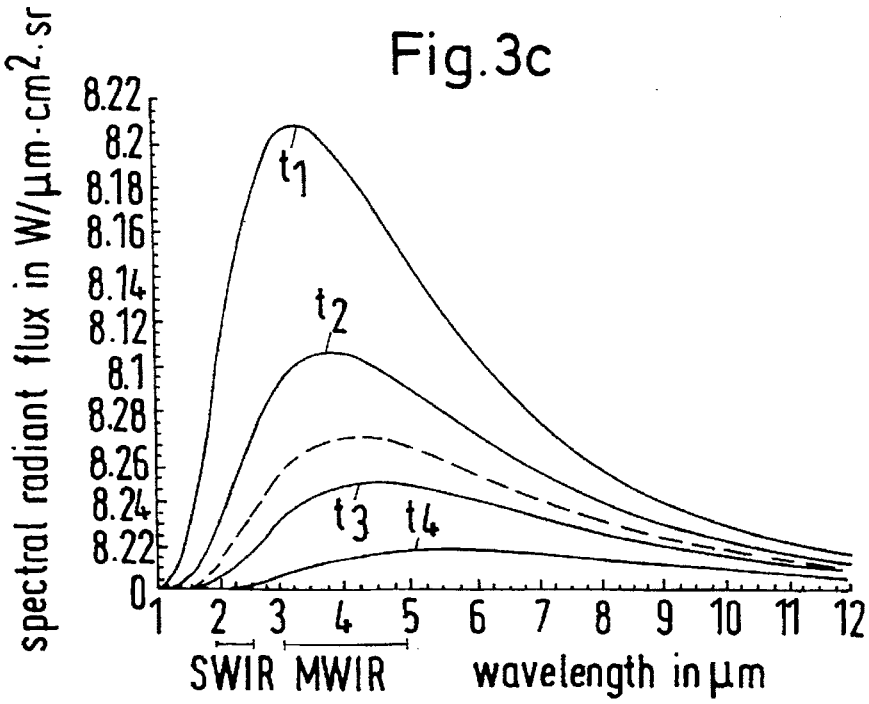

FLARE MASS FOR A DUMMY TARGET FOR PRODUCING A SELECTED SPECTRUM

BACKGROUND OF THE INVENTION

1. Field of the Invention

The invention relates to a mass for dummy target production.

2. Description of the Prior Art and Related Subject Matter

Objects to be protected such as ships, drilling platforms, tanks, etc., have large surfaces with relatively low surface temperatures for example approximately 0° to 20° C. for a chassis or a hull and a maximum of 80° to 100° C. for a chimney or stack. Thus, according to Planck's radiation law, this means that such objects to be protected have the simultaneous features of low radiant intensities in the short wave infrared range (SWIR range 2 to 2.5 μm) and high radiant intensities in the medium wave infrared range (MWIR range 3 to 5 μm) and long wave infrared range (LWIR range 8 to 14 μm).

Homing missiles such as so-called two-color infrared homing missiles are able to differentiate between radiant intensities in the SWIR range and those in the MWIR range. For detecting and tracking a target the homing missiles detect radiant intensities in the MWIR range and at the same time are able to establish radiant intensities in the SWIR range for discriminating with respect to dummy targets.

German patent application P 42 38 038.3 (not published before the filing date of the present application), corresponding to U.S. Pat. No. 5,397,236 issued Mar. 14, 1995 entitled "Method for Offering a Composite Dummy Target Formed From a Plurality of Active Masses Which Emit Spectrally Differentiated Radiation," Fegg et al., filed Nov. 12, 1993, discloses a method for providing a dummy target body, which is used for simulating the target signature of an object to be protected for an imaging homing missile, wherein flare masses are made to explode in a spatially and time displaced manner at the location of the dummy target body to be formed. The flare mass according to P 42 38 038.3 is composed of a mixture of phosphorus granules and small phosphorus flares and has a spectral radiant flux with a desired high percentage in the MWIR range, but the overall radiant intensity in the SWIR range clearly exceeds that of objects to be protected. Therefore homing missiles classify dummy targets produced according to P 42 38 038.3 as an illusion due to the radiant flux in the SWIR range and consequently do not home on dummy targets.

German OS 26 14 196 discloses an infrared radiator, which is produced by an incendiary composition formed from potassium nitrate and metallic boron or gunpowder or solid propellants, the burn-off temperature being higher than an object temperature of approximately 20° C. Thus, according to Planck's radiation law or Wien's displacement law the maximum of the radiant flux of the dummy target produced according to German OS 26 14 196 is at lower wavelengths than the maximum of the radiant flux of an object to be protected, which makes it possible for homing missiles to distinguish the dummy target from the target object.

German OS 35 15 166 describes a projectile for representing an infrared surface radiator, whose flare mass is formed from phosphorus, together with aluminum hydroxide used for passivating phosphorus, in order to slow the extinguishment time. The dummy target produced according to German OS 35 15 166 has a not negligible radiant flux percentage in the SWIR range, so that homing missiles can distinguish a dummy target from an object to be tracked. The addition of aluminum hydroxide only leads to a slight change in the specific gravity of the flare mass, which leads to no slowing of the action time of the flare mass or to the life of the dummy target.

German OS 23 59 758 discloses a flare mass of the type having an incendiary composition component and an inert component in which the inert component comprises metal carrier foils, which are coated with an incendiary composition component. This known flare mass is an infrared interference radiator, in which the weight or quantity ratio between the incendiary composition component and the inert component is optimized from the standpoint of extending the radiation time by slowing extinguishment but there is no mention of an adaptation of the radiant flux distribution to that of the target signature to be simulated.

SUMMARY OF THE INVENTION

An object of the present invention is to provide a flare mass of the type having an incendiary composition component and an inert component, with which it is possible to produce dummy targets, which in accordance with the target signature to be simulated of the objects to be protected have high radiant intensities in the MWIR range and low radiant intensities in the SWIR range.

Preferably the flare mass according to the invention is formed such that the MWIR radiant intensity of the dummy target produced is higher than that of the object to be protected, so that the dummy target represents a super-optimum key stimulus for an infrared homing missile and is consequently sighted by the missile instead of the object to be protected. It is advantageous if, in the case of the flare mass according to the invention, the extinguishment rate is simultaneously slowed.

The flare mass can in particular be constituted by mixtures of an inert component and an incendiary composition component having approximately 5 to 99% by weight of a pyrotechnic incendiary composition, with the remainder being the inert component. When choosing the thermal characteristics of the inert component it is e.g. possible to take account of the specific heat and/or thermal expansion of the inert component, apart from the density thereof, the latter also influencing the service life of the dummy target produced due to its influence on the specific gravity of the flare mass. The spectral radiant flux of the dummy target can be selectively modified via selective radiation characteristics of the inert component, namely emittance, absorptivity, transmittance and reflectivity of the inert component. If the inert component consists of a particle filling and a particle envelope, the spectral radiant flux of the dummy target can be adjusted by means of the material and/or the volume of the particle filling and via the density thereof and/or the pressure prevailing in the particle filling. The spectral radiant flux of the dummy target can also be adjusted via the material of the particle envelope, its surface characteristics and its thickness.

The incendiary composition component of materials having a burning temperature below 600° C. The incendiary composition component is preferably formed preferably consists of red phosphorus, which can have an ignition temperature of approximately 400° C. It is particularly advantageous if the red phosphorus is treated in such a way that it requires an ignition temperature of less than 400° C. and this can be achieved by adding a further substance to the red phosphorus for the reduction of the ignition temperature, e.g. at least one catalyst, and/or by individually enveloping the red phosphorus particles e.g. with paraffin wax.

The inert component comprises a material which is substantially inert from approximately 0° C. to approximately 600° C. Silicates such as kieselguhr (diatomaceous earth) have proved suitable as the inert component material. Preferably the inert component is formed by microballoons, e.g. of materials such as those known under the trade names Q-Cell or Extendospheres.

The inert component can be in the form of a binder or a carrier material for the incendiary composition component. The spectral radiant flux of the dummy target can be adjusted by the material selection and the thickness and/or the specific thermal characteristics of the carrier material. It also falls within the inventive concept to adjust the spectral radiant flux of the dummy target by radiation-physics characteristics of the carrier material, namely spectral emissivity, absorptivity and/or transmissivity.

In the case where the inert component has particles having a particle filling and a particle envelope, the particle filling can be a gas or a foam with special absorption bands. A glass with optical filtering properties has proved suitable for the particle envelope.

The invention is based on the surprising finding that it is possible to supply a flare mass for forming a dummy target for any random object to be protected, the dummy target having radiant flux configuration produced through the skillful choice of the parameters of the pyrotechnic incendiary composition and the inert additive, as a function of the wavelength, and the dummy target being deceptively similar to that of the object to be protected and more attractive for a homing missile, because the radiation maximum of the dummy target is displaced into the longer wave infrared range compared with known flare masses and by selective radiation emission the radiant intensities in the SWIR range are suppressed and the radiant intensities in the MWIR range are increased.

DESCRIPTION OF THE DRAWINGS

FIG. 3*a* is a schematic illustration of the burning sequence of a flare mass constructed in accordance with the principles of the present invention.

FIG. 3*b* is a graph illustrating the temperature curve of a burning flare mass of the type shown in FIG. 3*a* with respect to the burning sequence.

FIG. 3*c* is a graph showing the spectral radiant flux of the flare mass shown in FIG. 3*a* as a dashed curve obtained by superimposing the radiant flux curves of the constituents thereof, respectively shown in solid lines.

DESCRIPTION OF THE PREFERRED EMBODIMENTS

Figure 1:
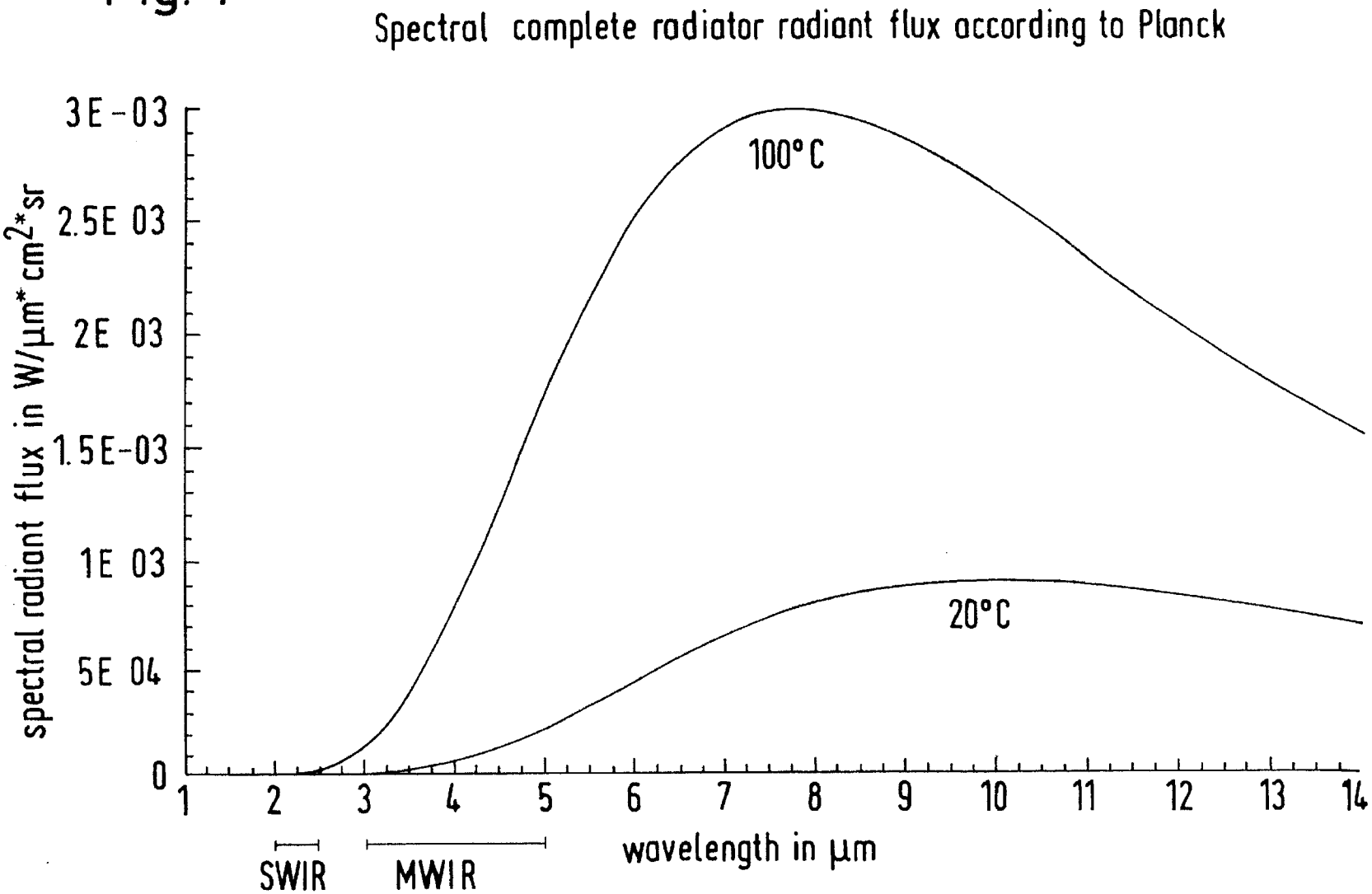
FIG. 1 is a graph showing the spectral radiant flux of a Planck black body radiators respectively having a surface temperature of 20° C. and 100° C.

FIG. 1 shows the spectral radiant flux calculated according to Planck's black body radiation law for a typical object to be protected of the aforementioned type having surface temperatures of approximately 20° or 100° C. The previously mentioned simultaneous features of objects to be protected, namely low infrared radiated power per surface unit in the range 2 to 2.5 μm and high radiated power per surface unit in the range 3 to 5 μm can be from FIG. 1.

Figure 2:
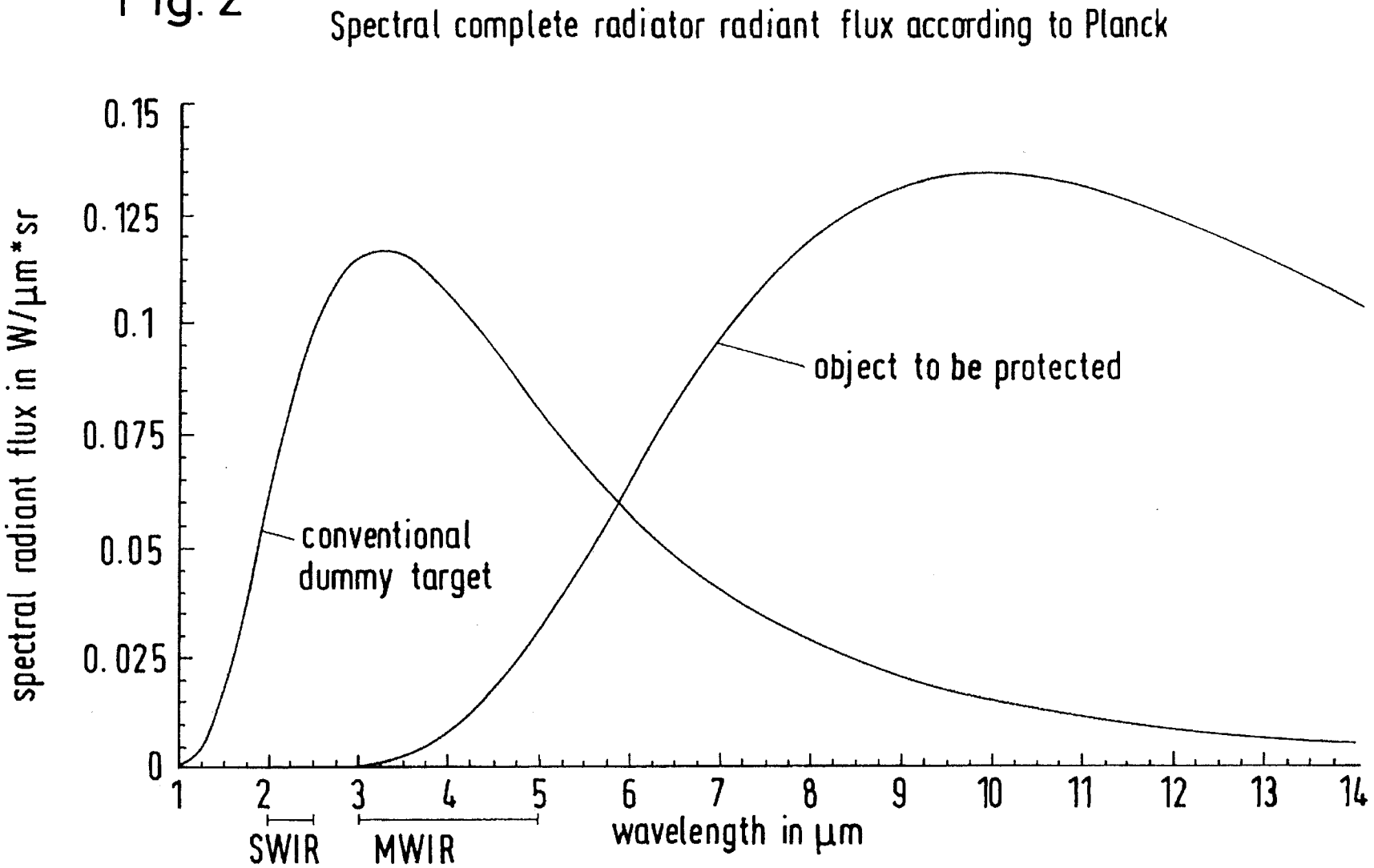
FIG. 2 is a graph representing the spectral radiant flux of a conventional dummy target compared to that of a typical object to be protected.

Conventionally constructed dummy targets, however, have in the much more radiation in the SWIR range and due to their small surface much less radiation in the MWIR range than the objects which they are supposed to protect shown in FIG. 2. Thus, homing missiles particularly two-color infrared homing missiles, are easily able to distinguish between dummy targets and the objects which they are intended to protect, because they measure radiation in the MWIR range in order to detect and track an object and the detection of radiation in the SWIR range is utilized in order to be able to distinguish dummy targets from the target objects. For spectral dummy target adaptation it is necessary to effect a displacement of the radiant flux maximum toward higher wavelengths. According to Wien's displacement law this can be achieved by lowering the temperature of the dummy target and simultaneously the amount of the radiant flux in the MWIR range is reduced. A dummy target temperature of approximately 300° to 500° C. represents a good compromise in this context.

According to the invention a flare mass is used for spectral dummy target adaptation, which comprises a pyrotechnic incendiary composition A and an inert additive B (linked with a binder to a carrier material), as is e.g. shown in FIG. 3*a*.

According to the invention, the pyrotechnic incendiary composition is preferably red phosphorus with an ignition temperature of approximately 400° C., or red phosphorus to which small amounts of an additional substance have been added, such as e.g. a catalyst and/or the red phosphorous particles are individually enveloped e.g. with paraffin wax, so that it requires a clearly lower ignition temperature.

According to the invention it is possible to use as the inert additive all substances which are inert in the temperature range of approximately 0° C. to approximately 600° C. Preferably use is made of inert substances such as kieselguhr and/or microballoons, Q-Cell, Extendospheres, etc., specific binders and/or specific carrier materials.

The inert additive B used for heat conduction or heat dissipation, the binder and the carrier material are chosen such that they ensure a reduction of the dummy target temperature, so that the spectral radiant flux of the dummy target is displaced toward higher wavelengths in the infrared range and consequently there are high radiant intensities in the MWIR range and low radiant intensities in the SWIR range. This temperature drop, which makes the dummy target more attractive for a radiation-sensitive homing missile than objects to be protected, is described in greater detail hereinafter with respect to FIGS. 3*a*, 3*b* and 3*c*.

A flare mass formed an ignition sequence determined by successively arranged units of pyrotechnic incendiary composition particle A and two particles B of inert additive, so that the spatial arrangement "A B B A B B" shown in FIG. 3*a* is obtained, is ignited at time $t_1$. As a result of flare mass ignition the first particle A of the pyrotechnic incendiary composition is brought in the first burning stage to its ignition temperature, which is e.g. 500° C. In the second burning stage characterized by the time $t_2$, the second particle along the ignition sequence path, namely a heat dissipating additive particle B, ensures that the temperature drops. The third particle, which is also a heat dissipating additive particle B, is also used for temperature reduction purposes, so that following the third burning stage characterized by the time $t_3$ the ignition temperature of the pyrotechnic incendiary composition is reached and is e.g. 300° C. At time $t_4$ the fourth particle, a pyrotechnic incendiary mass particle A, is ignited, so that the temperature is again brought to the burning temperature of the pyrotechnic incendiary composition. This restores the situation which was present at time t, and then the above described three burning stages are cyclically repeated, so that the temperature curved plotted against the ignition sequence assumes a sawtooth-like configuration, as can be seen from FIG. 3*b*.

Thus, according to Planck's radiation law, the first, burning particle A of the pyrotechnic incendiary mass at time $t_1$ radiates the highest spectral radiant flux with a maximum at the lowest wavelength and the fourth, heated particle A of the pyrotechnic incendiary composition at time $t_4$ radiates the lowest spectral radiant flux with a maximum at the highest wavelength, as can be seen from FIG. 3*c*. The spectral radiant flux of the flare mass, shown as a dashed line in FIG. 3*c* and which is constituted by the time average of the spectral radiant fluxes occurring during a cycle formed from three stages, supplies a much higher overall radiant flux in the MWIR range than in the SWIR range.

This displacement toward higher wavelengths can be adjusted by the quantity ratio of the pyrotechnic incendiary composition A and inert additive B and/or by selected thermal characteristics of the inert additive, such as e.g. the specific heat and thermal expansion. The magnitude of the displacement of the maximum of the spectral radiant flux of the dummy target is mainly limited by the ignition temperature of the pyrotechnic incendiary composition A which is used.

The addition of the inert additive B to the pyrotechnic incendiary composition A, connected by a binder to a carrier material not only leads to the desired displacement of the maximum of the spectral radiant flux into the MWIR range, but also to a slowing down of the extinguishment rate. If the additive B is also selected that, as a result of its specific gravity the weight and consequently rate of descent of the flare mass is reduced, without modifying the buoyancy, there is an advantageous increase in the action time of the flare mass and the service life of the dummy target formed therefrom.

As can be gathered from a comparison of FIGS. 1 and 3*c*, however, the radiant fluxes of the dummy target in the complete SWIR range still exceed the radiant fluxes of an object to be protected. The ratio of the radiant intensity in the SWIR range to the radiant intensity in the MWIR range, which according to Planck's radiation law is exclusively a function of the temperature, can be adjusted even better by using selective radiation properties of the inert additive for further spectral dummy target adaptation in accordance with the invention.

Figure 4:
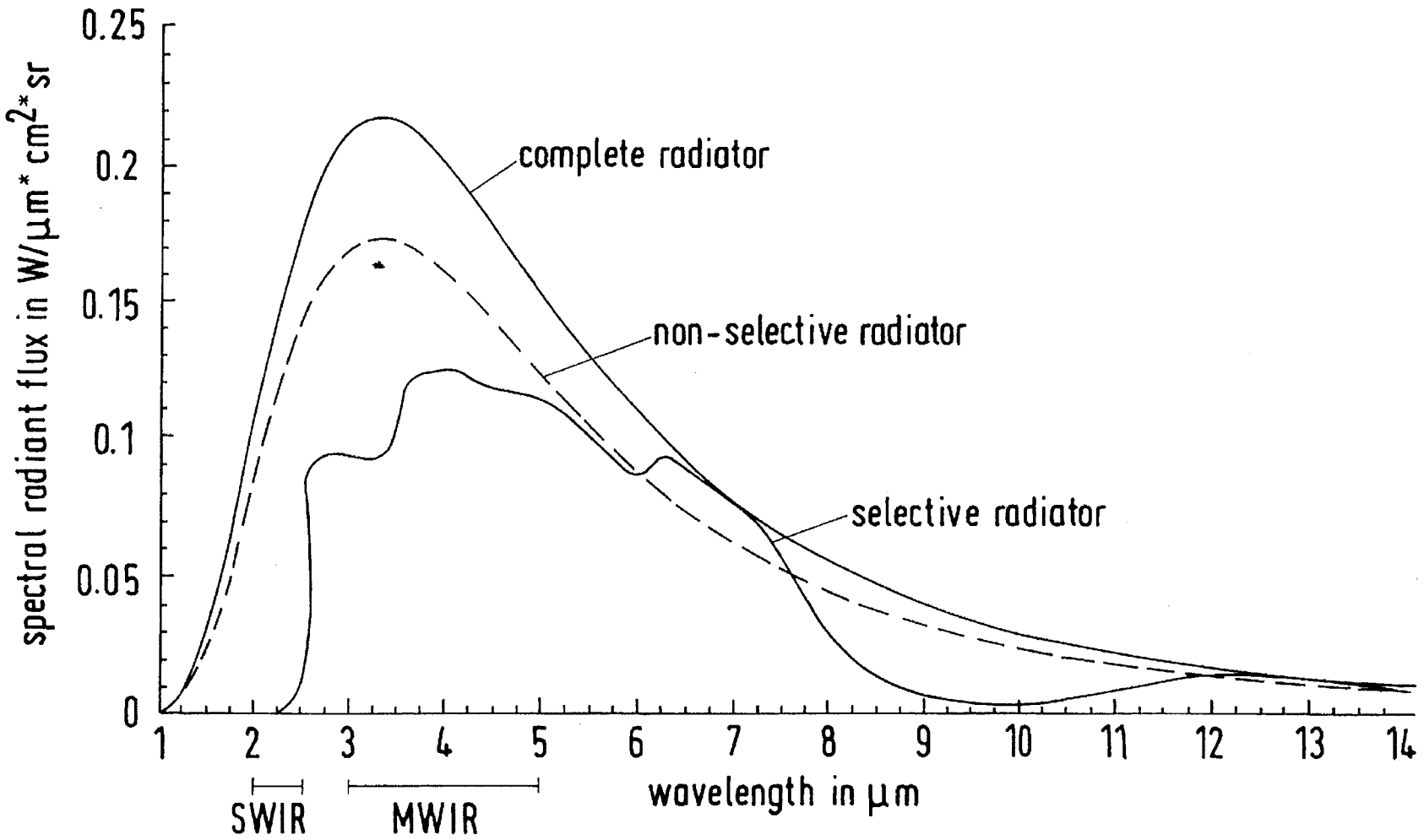
FIG. 4 is a graph representing the spectral radiant flux of a black body radiator, a gray body or non-selective radiator, and a selective radiator.

According to Kirchoff's law (also known as Kirchoff's principle) there are three types of infrared radiators shown in FIG. 4, which can be classified on the basis of their emittance E as a function of the wavelength λ. A complete radiator exists for $\epsilon(\lambda)=1$, a non-selective radiator for $\epsilon(\lambda)=\text{constant}<1$ and a selective radiator for $\epsilon(\lambda)=f(\lambda)$. Thus, selective radiators are characterized by their radiation characteristics dependent on the wavelength λ.

The selective radiation characteristics of the inert additive B are determined by its selective emittance, selective absorptivity, selective transmittance and/or selective reflectivity, which is described below with respect to FIGS. 5*a* and 5*b*.

Figure 5A:
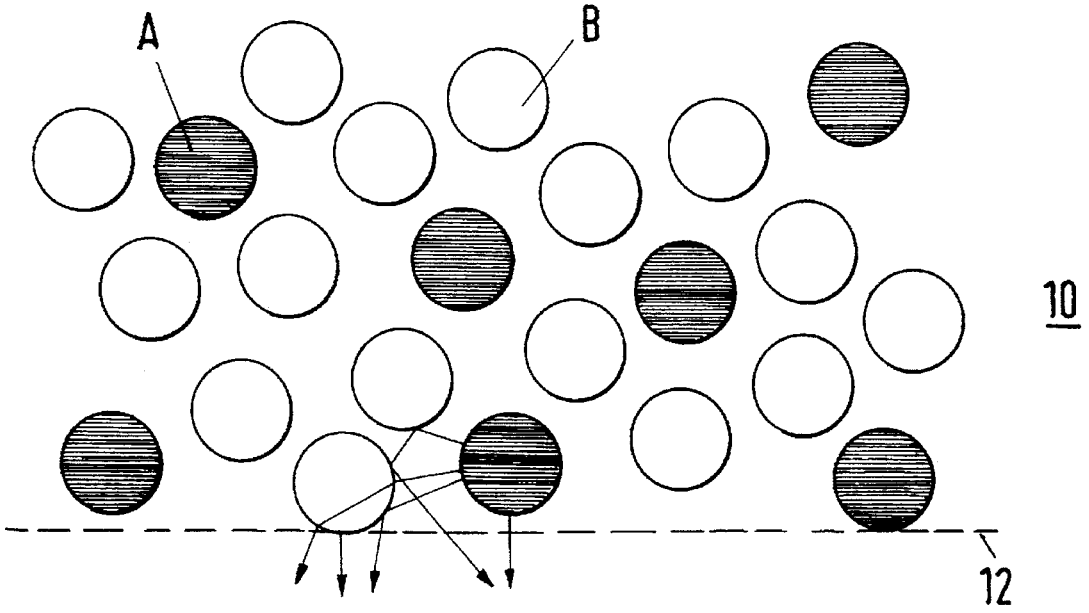
FIG. 5*a* schematically illustrates an ignited flare mask constructed in accordance with the principles of the present invention showing radiation propagation paths at its surface.
Figure 5B:
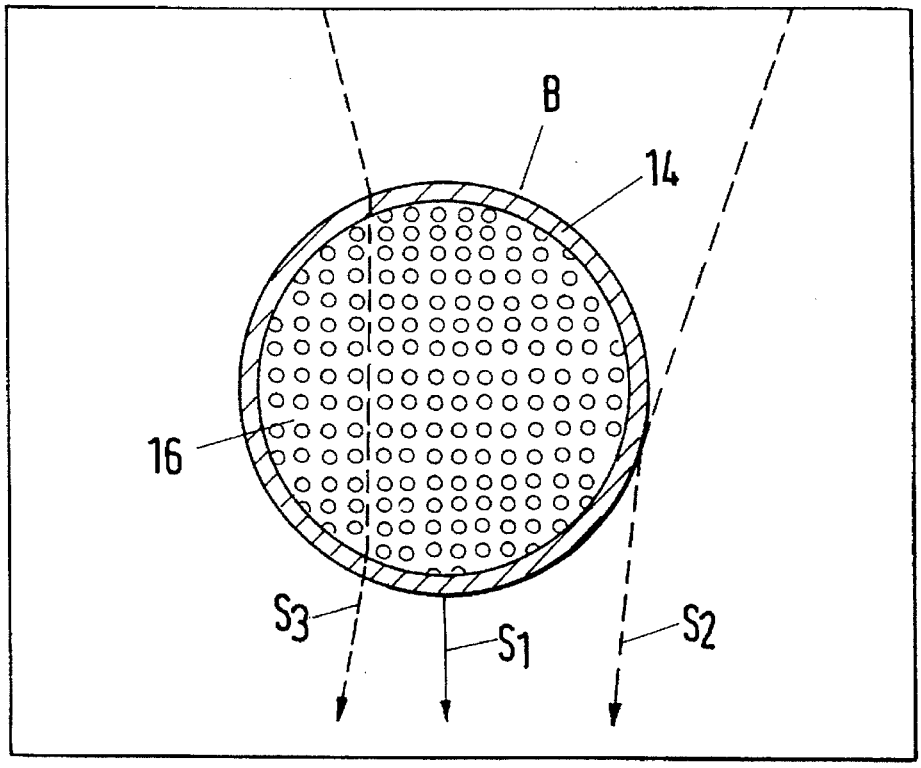
FIG. 5*b* is a schematic illustration of the selective radiation pattern of a flare mass constructed in accordance with the principles of the present invention, achieved by additive particles.

FIG. 5*a* shows a small selection (schematically indicated by arrows) of radiation propagation on the surface 12 of a flare mass 10 determined by the selective radiation characteristics the flare mass 10 incorporating both particles A of pyrotechnic incendiary composition and particles B of inert additive. The most important paths in the vicinity of a particle B of the inert additive, which has a particle filling 16 surrounded by a particle envelope 14, are illustrated in FIG. 5*b*. The central beam path $S_1$ represents the selective emission of the temperature radiation of the additive particle B, the right represents beam path $S_2$ represents the selective reflection of extraneous radiation, which can emanate both from the infrared radiation of the pyrotechnic substance B and the infrared radiation of adjacent additive particles, and the left beam path $S_3$ represents the selective absorption and/or transmission of the extraneous radiation to the particle envelope 14 and the particle filling 16.

Other than by selective emission, selective reflection, selective absorption and/or selective transmission, the radiation characteristics of the flare mass can be adjusted by means of the particle envelope 14, which e.g. incorporates a special filter glass type, the surface characteristics of the particle envelope 14, the thickness of the particle envelope 14, the material of the particle filling 16, which e.g. includes a gas or a foam having special absorption bands, the volume of the particle filling 16, the density of the particle filling 16, the pressure prevailing in the particle filling 16 and/or the mixing ratio of pyrotechnic incendiary composition A to additive B.

Figure 6A:
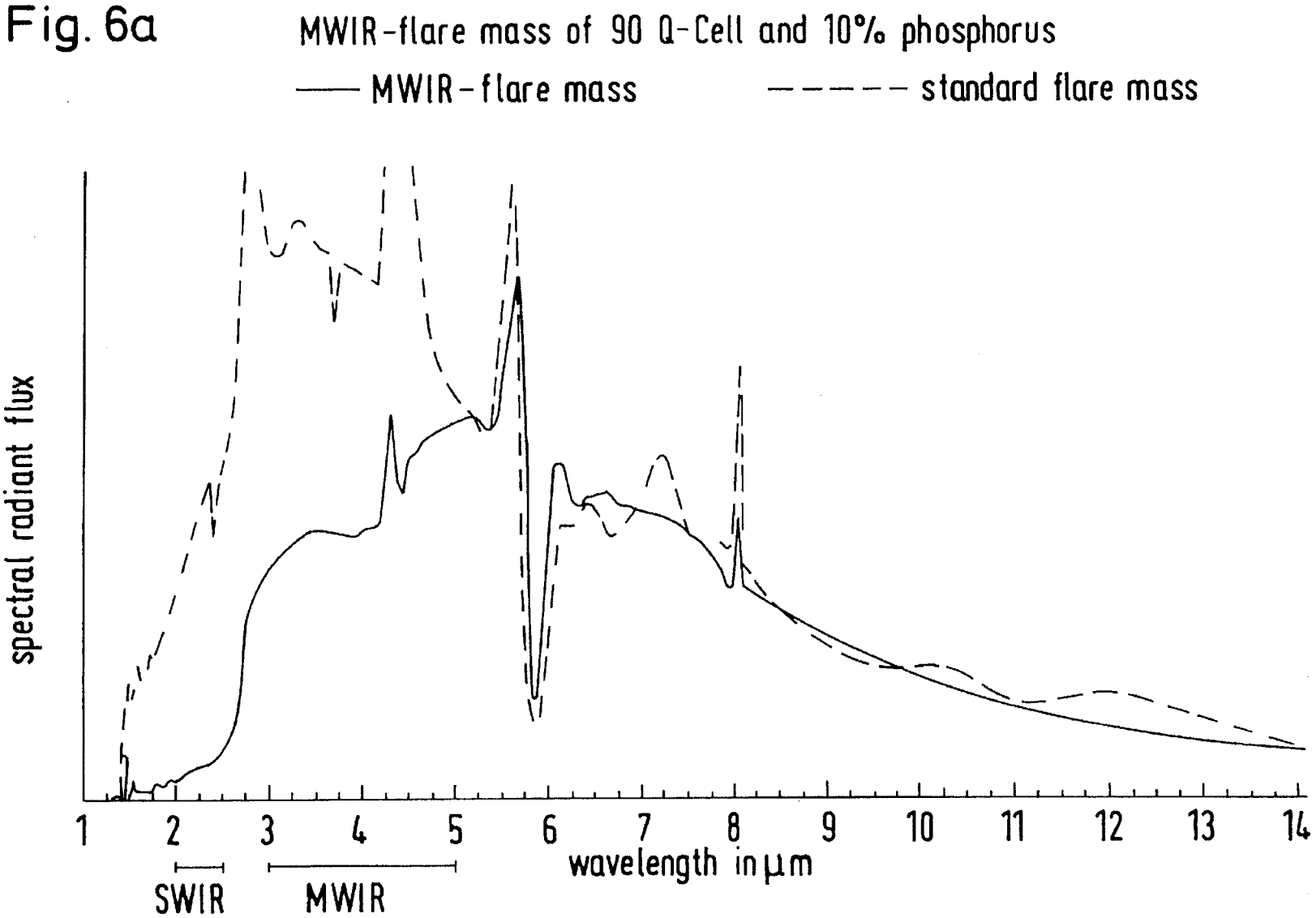
FIG. 6*a* is a graph representing the spectral radiant flux of a MWIR flare mask constructed in accordance with the principles of the present invention, compared to the spectral radiant flux of a standard flare mass.
Figure 6B:
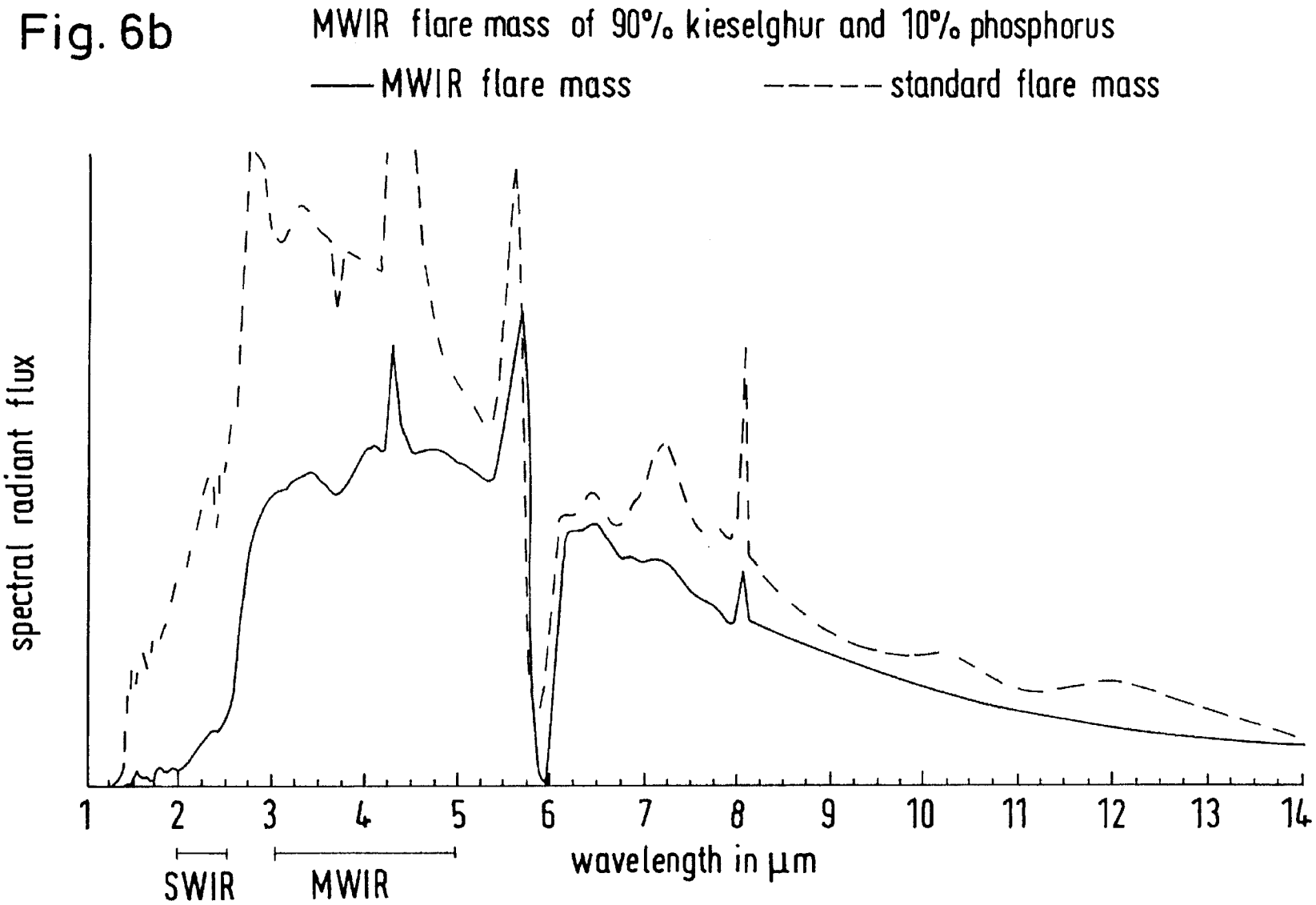
FIG. 6*b* is a graph showing the spectral radiant flux of flare mass in a further embodiment of the invention, compared to the spectral radiant flux of a standard flare mass.

FIGS. 6*a* and 6*b* show two MWIR flare masses according to the invention in each case compared with a standard flare mass. The MWIR flare mass according to FIG. 6*a* is formed from 90% by weight Q-Cell and 10% by weight red phosphorus and the MWIR flare mass of FIG. 6*b* from 90% by weight kieselguhr and 10% by weight red phosphorus. In principle, however, all mixtures with a phosphorus percentage of 5 to 99% by weight are possible.

In FIG. 6*a* it is clear from a comparison of the MWIR flare mass with the standard flare mass that there is a spectral radiation maximum displacement of approximately 5 μm toward the highest wavelength of the MWIR range, as well as the radiant flux burst to approximately 2.6 μm and consequently in the complete SWIR range due to the selective radiation property of Q-Cell.

The spectral characteristic shown in FIG. 6*b* is very similar to that of FIG. 6*a* and has a radiation maximum in the MWIR range, approximately at 4.5 μm, and suppresses the radiated power to approximately 2.6 μm, so that in the SWIR range there is essentially a negligible spectral radiant flux.

Unlike the standard flare mass, which not only has a non-negligible spectral radiant flux in the SWIR range, but also the integral over its spectral radiant flux in the SWIR range is higher than the integral over its spectral radiant flux in the MWIR range, as can be gathered from FIGS. 6*a* and 6b, the MWIR flare masses according to the invention result in dummy targets, which simulate in true-to-nature manner the spectral characteristics and which are surface of the object to be protected and also more attractive for a radiation-sensitive homing missile. This leads to the desired deflection of the homing missile from an object to a dummy target. Thus, a MWIR flare mass according to the invention provides a reliable protection of an object against missiles equipped with two-color infrared target finders.

Although modifications and changes may be suggested by those skilled in the art, it is the intention of the inventors to embody within the patent warranted hereon all changes and modifications as reasonably and properly come within the scope of their contribution to the art.

We claim as our invention:

1. Flare mass for a dummy target for simulating an actual tarrier having a spectral radiant flux distribution with a maximum, comprising an incendiary composition component and an inert component, said inert component having a spectral radiant flux distribution with a maximum, said incendiary composition component and said inert component being mixed with a weight ratio of the incendiary composition component and the inert component which produces a maximum of the spectral radiant flux distribution of the dummy target matched to the maximum of spectral radiant flux distribution of the actual target to be simulated, causing the maximum of the spectral radiant flux distribution of the dummy target to be displaced toward longer wavelengths compared with than said maximum of the spectral radiant flux distribution of the incendiary composition component alone.

2. A method for producing a dummy target for simulating an actual target having a spectral radiant flux distribution with a maximum comprising the steps of:

providing an incendiary composition component having a spectral radiant flux distribution with a maximum;

providing an inert component;

mixing said incendiary composition component and said inert component with a weight ratio to produce a mixture; and adjusting said weight ratio for producing a dummy target, upon ignition of said mixture, having a spectral radiant flux with a maximum matched to the maximum of the spectral radiant flux distribution of said actual target to be simulated, causing said maximum of the spectral radiant flux distribution of the dummy target to be displaced toward longer wavelengths than said maximum of the spectral radiant flux distribution of the incendiary composition component alone.

3. A method according to claim 2, wherein the step of adjusting the spectral radiant flux of the dummy target comprises adjusting the spatial arrangement of the incendiary mass component and the inert component.

4. Flare mass according to claim 1 wherein the inert component has selective, radiation-influencing characteristics.

5. A method according to claim 2 wherein the step of adjusting the spectral radiant flux of the dummy target comprises adjusting the inert component density.

6. A method according to claim 2 herein the step of adjusting the spectral radiant flux of the dummy target comprises adjusting the thermal characteristics of the inert component.

7. Flare mass according to claim 1 wherein the inert component comprises discrete particles.

8. Flare mass according to claim 7, wherein the inert component comprises particles formed from a particle envelope with a particle filling.

9. Flare mass A method according to claim as claimed in claim 2, wherein said inert component comprises particles formed from a particle envelope with a particle filling, and wherein the step of adjusting the spectral radiant flux of the dummy target comprises adjusting the material selection for the particle envelope.

10. Flare mass according to claim 8 wherein the particle envelope comprises glass.

11. Flare mass according to claim 10, wherein the particle envelope comprises optically selectively filtering glass.

12. Flare mass according to claim 8 wherein the particle filling comprises a gas with selective absorption bands.

13. Flare mass according to claim 1 wherein the incendiary mass component comprises red phosphorus.

14. Flare mass according to claim 13, wherein the incendiary mass comprises red phosphorous with a reduced ignition temperature.

15. A flare mass as claimed in claim 1 wherein the incendiary mass component comprises discrete particles.

16. A method according to claim 2, wherein the step of adjusting the spectral radiant flux of the dummy target comprises adjusting the spatial shape of the incendiary composition component.

17. A method as claimed in claim 2 wherein the step of adjusting the spectral radiant flux of the dummy target comprises adjusting the spatial shape of the inert component.

18. A method as claimed in claim 2 wherein said inert component comprises particles formed from a particle envelope with a particle filling, and wherein the step of adjusting the spectral radiant flux of the dummy target comprises adjusting the material selection for the particle filling.

* * * * *